US005727260A

United States Patent [19]

Torch et al.

[11] Patent Number: 5,727,260

[45] Date of Patent: Mar. 17, 1998

[54] ROLLER BLADE SKATING GARMENT

[76] Inventors: Tia Torch; Benjamin A. Torch, both of 39 Sagamore Rd., Bronxville, N.Y. 10708

[21] Appl. No.: 788,333

[22] Filed: Jan. 27, 1997

[51] Int. Cl.[6] ..... A41D 13/00

[52] U.S. Cl. ..... 2/455; 2/465; 2/466; 2/467

[58] Field of Search ..... 2/455, 465–467, 2/51, 908, 267, 69

[56] References Cited

U.S. PATENT DOCUMENTS

| | | | |
|---|---|---|---|
| 1,468,072 | 4/1923 | Ogle . | |
| 2,446,006 | 7/1948 | Hendricks | 2/467 |
| 2,621,327 | 12/1952 | Amoroso | 2/467 |
| 2,637,032 | 7/1953 | Pinsuti . | |
| 3,212,690 | 10/1965 | Green | 2/467 |
| 4,151,613 | 5/1979 | Rhee | 2/465 |
| 4,807,301 | 2/1989 | Ferber | 2/465 |
| 4,837,859 | 6/1989 | Hamberg | 2/455 |
| 4,894,867 | 1/1990 | Ceravolo et al. . | |
| 5,034,998 | 7/1991 | Kolsky | 2/465 |
| 5,038,408 | 8/1991 | DeBaene . | |
| 5,086,514 | 2/1992 | Ross . | |
| 5,157,789 | 10/1992 | Klass . | |
| 5,500,952 | 3/1996 | Keyes | 2/465 |
| 5,557,801 | 9/1996 | Jakus . | |

FOREIGN PATENT DOCUMENTS

| | | | |
|---|---|---|---|
| 2624354 | 6/1989 | France | 2/455 |

*Primary Examiner*—Gloria Hale

*Attorney, Agent, or Firm*—Martin J. Spellman, Jr.

[57] ABSTRACT

A garment for protecting the hip and coccyx area while roller blading without inhibiting the freedom of maneuverability. It comprises a generally triangular garment worn over the derriere increasing in thickness from the sides to the center and tapering down between the legs. Straps around the upper legs and waist secure it to the user.

1 Claim, 4 Drawing Sheets

ROLLER BLADE SKATING GARMENT

BACKGROUND OF THE INVENTION

1. Field of the Invention

In recent years there has been a fantastic growth in the sport known as roller blade skating. A least three wheels usually are aligned on the underside of a skater's shoe so the effect is a single blade skate. In this case the "blade" consists of aligned rolling elements, thus the terminology roller blade skating. It gives the skater a capability of performing stunts and movements very similar to those that previously could be performed only on ice with ice skates and could not be performed using conventional four-wheel roller skates in the past.

With the growth of this sport, and as the consequence of it, there has been as sharp increase in the number of injuries received by, skaters, the most serious ones being broken coccyx and hip bones, as well as very sore derrieres. Up to the present time there has not been a suitable protective garment available to protect skaters from the injuries which are endemic to this particular sport. Protective garments or pads previously available either only partially protected the vulnerable areas, or, if they did, were usually confining and unduly limited the freedom of movement of the skater.

It is an object of the present invention therefore to provide a protective garment for use by an individual when roller blading. It is also a goal of the invention improvement to provide a garment that does not inhibit the freedom of movement of the wearer in utilizing the garment.

The garment of this invention provides a great improvement in safety to the skater and protection against coccyx and hip injuries due to the inevitable falls of one participating in this sport.

2. Prior Art

U.S. Pat. No. 4,894,867—Ceravolo et al discloses padded sports trunks or shorts with padding in the buttocks area. It is worn as part of sports apparel.

U.S. Pat. No. 5,086,514—Ross discloses an inflatable padded cushion for use when snowboarding to cushion the blow when one falls on their rear.

In U.S. Pat. No. 5,157,789—Klass a hospital gown is disclosed which has a sealable pocket over the hips and thigh areas of the wearer which pocket receives an impact protective air bubble material liner to reduce the severity of injuries which may occur from accidental falls.

U.S. Pat. No. 1,468,072—Ogle discloses an inflatable cushion to be worn suspended from the waist and worn between inner and outer garments with a valved tube so the wearer can selectively inflate and deflate the cushions. It is used to ameliorate the pain of piles.

U.S. Pat. No. 2,637,032—Pinsuti discloses a garment with pockets over the buttocks area for receiving pads to provide a soft padded area for the wearer when sitting.

U.S. Pat. No. 5,038,408—DeBaene discloses work pants with padded knees and wear resistant material on the outer surfaces of the knees and rear panels of the legs.

SUMMARY OF THE INVENTION

In accordance with the present invention there is provided a garment suitable for adequately protecting the hips and coccyx area of an individual while participating in the sport known as roller blading.

The garment of this invention provides significant protection to the coccyx and hip areas and yet at the same time is worn with facility and its utilization does not inhibit the freedom of maneuverability of the user.

The protective garment of the present invention comprises a generally triangular garment worn over the derriere with the side areas being thin and narrow, with the thickness increasing to the thickest point over the coccyx bone and tapering down into between the legs. It also tapers outwardly, is substantially padded over the hip area, tapering down to the edges as one goes outward and down so that it easily passes under the buttocks of the user. Straps secure it around the waist and legs of the user and side extensions each have a fastener strap extending from there and joinable with end portions of a bifurcated strap which passes from the lower derriere area up between the legs.

All buckles for the straps are fastened together towards the front of the body of the wearer to facilitate easy donning and removal of the garment.

BRIEF DESCRIPTION OF THE DRAWING

Referring to the accompanying drawing which forms a part of this application.

ILLUSTRATIVE SPECIFIC EMBODIMENT

Referring to the accompanying drawing, a pair of skaters 2 and 4 are shown wearing the padded garments of the present invention. The skaters 2 and 4 each have a pair of skating boots 10 with inline rollers 12 on each, collectively forming a roller blade. They have knee pads 7 and 9.

Figure 7:
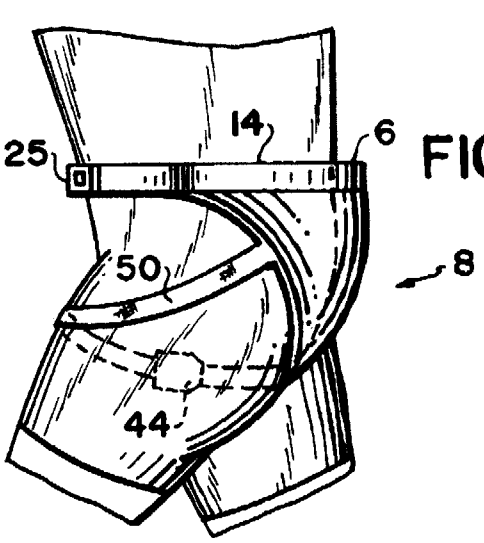
FIG. 7 shows the garment in place on the derriere of a wearer and the positions of the straps when fastened.

Garment 6 of the present invention is shown on the derriere 8 of a wearer 4 and the various straps thereof are connected in FIG. 7.

The garment 6 includes left and right waistbands 14 and 16 respectively connected by central waistband 11. At the ends 17 and 18, are male portions 23 of a buckle 22 and female portions 25 of the same buckle 22 which are used to secure the garment 6 to the waist of the wearer 4.

The garment 6 is comprised of two outwardly sweeping thickened sections 28 and 30 which are thickest at the central portion 32 and thinner as they slope outwardly, as indicated at 33 and 34, and taper downwardly at 37 and 38 and towards the crotch end portion 36. Extending laterally from the bottom 40 of the crotch portion 36 are straps 42 and 46 with buckles 44 and 48 at the ends 45 and 47 thereof. Intermediate on the curves 49–51, straps 50 and 52 extend outwardly and are joined with the buckles 44 and 48 when in place on the wearer 4.

Figure 6:
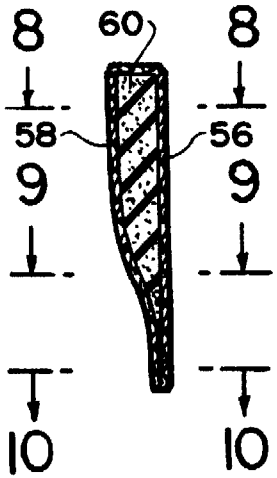
FIG. 6 is a sectional view of the garment taken along lines 6—6 of FIG. 3.
Figure 8:
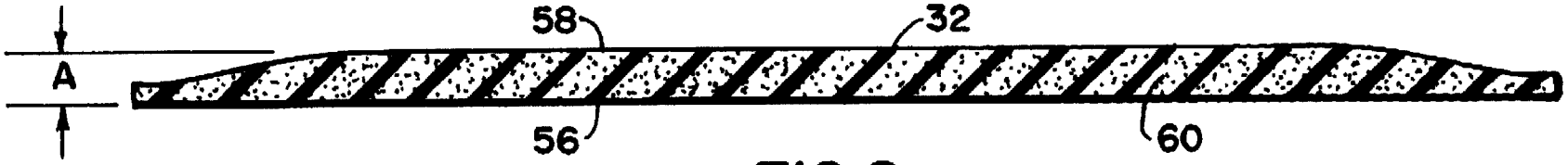
FIG. 8 is a sectional view along lines 8—8 of FIG. 3.
Figure 9:
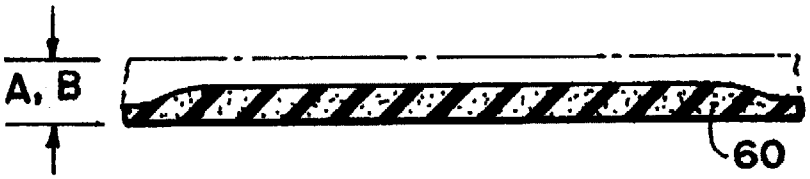
FIG. 9 is a sectional view along lines 9—9 of FIG. 3.
Figure 10:
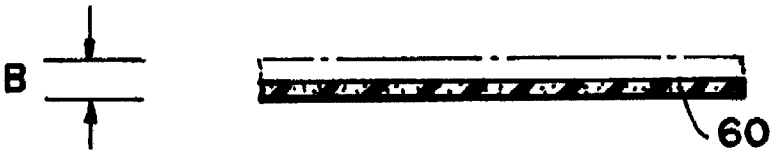
FIG. 10 is a sectional view along lines 10—10 of FIG. 3.

As shown in FIG. 6, the garment 6 is relatively thick through the central portion 32 and tapers down to fit in to the crotch area 36. The front and back surfaces 56 and 58 of the garment 6 are typically comprised of a substantial canvas-like material which may have decorative patterns on it and stitching to hold the padding 60 in place which is distributed in its thickest portions along the areas covering the hips, coccyx, and tapers down to the thinner portion as it goes to the periphery.

Figure 1:
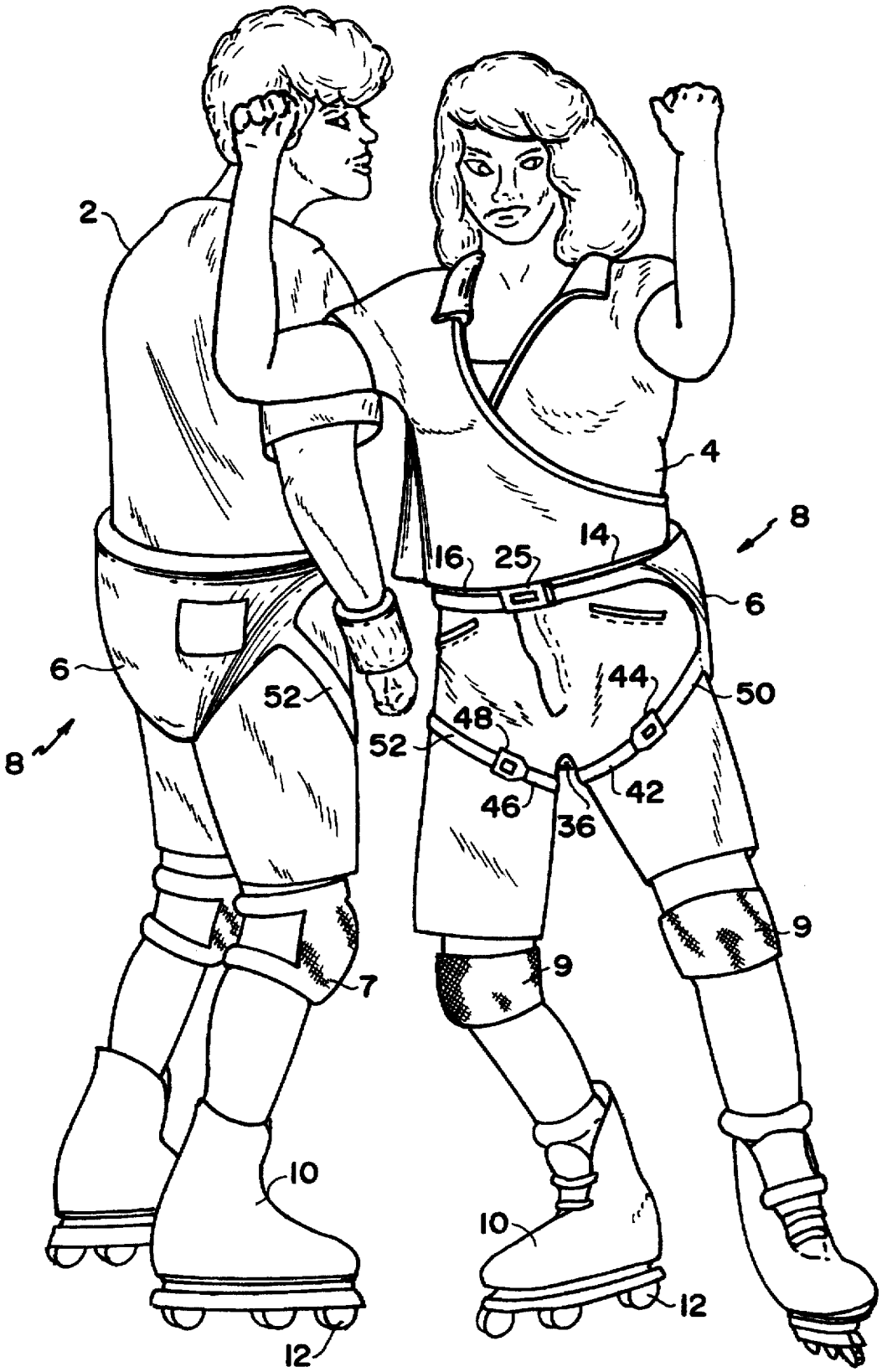
FIG. 1 is a perspective view of a pair of roller blade skaters each wearing the protective garment of this invention.
Figure 2:
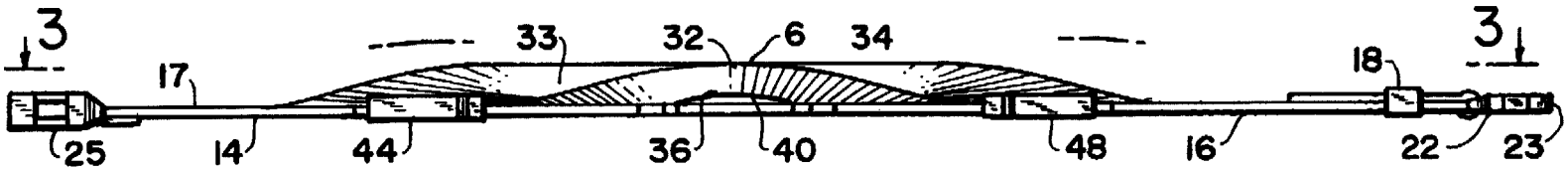
FIG. 2 is a bottom view of the garment laid flat and taken along line 2—2 of FIG. 3.
Figure 3:
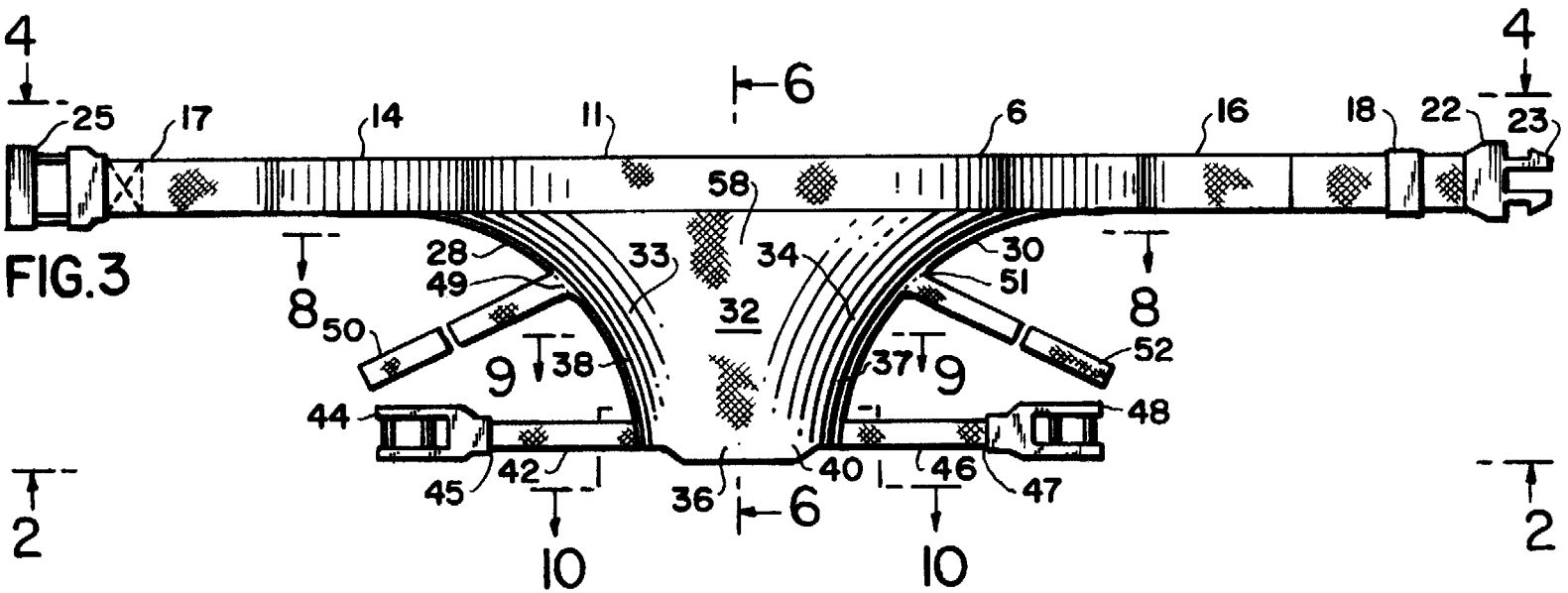
FIG. 3 is a front plan view of the garment laid flat and taken along line 3—3 of FIG. 2.
Figure 4:
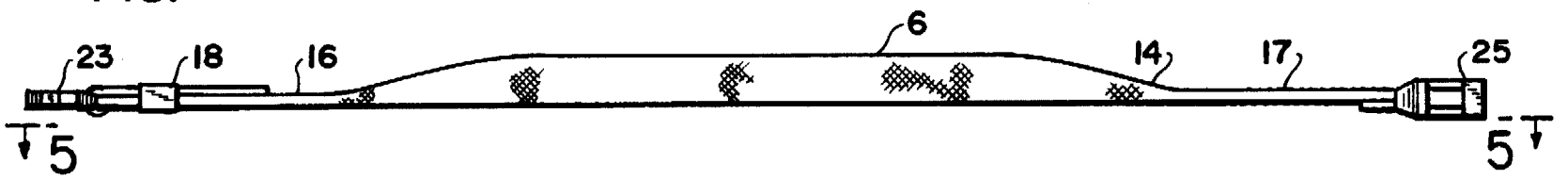
FIG. 4 is a top view of the garment with it flat and taken along line 4—4 of FIG. 3.
Figure 5:
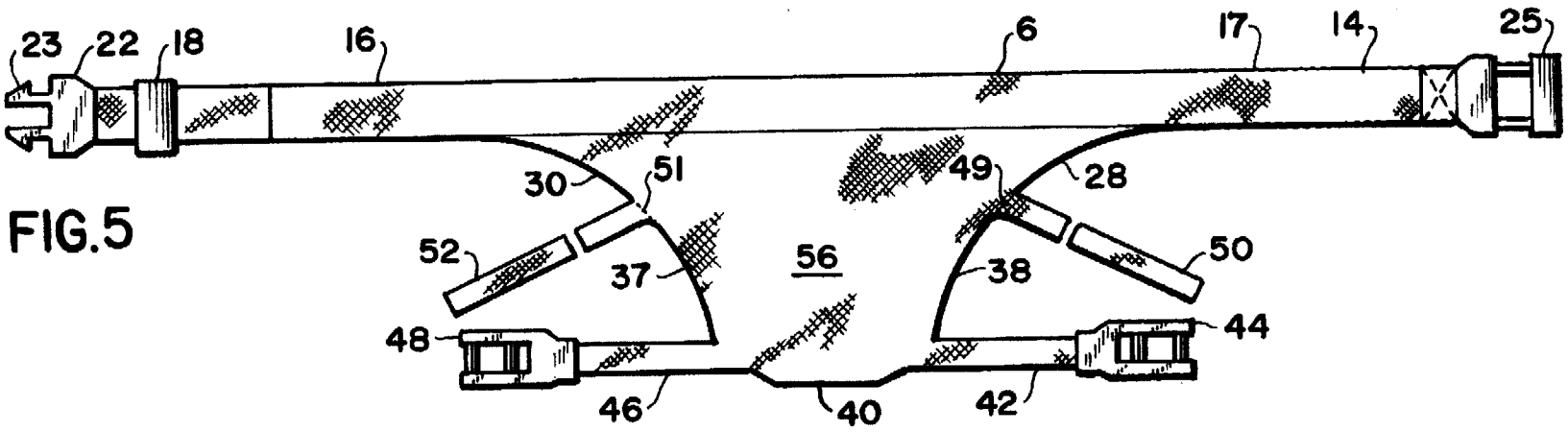
FIG. 5 is a rear plan view of garment and is the reverse of FIG. 3.

The FIGS. 1 and 7 show the device 6 held in place on the body 8 to cover the coccyx bone and hip areas to prevent injuries to those areas which are the most commonly impacted by a fall in roller blading.

In tests of the device the number of contusions and similar injuries received by users was substantially fewer and milder than one would encounter when not using the garment of the present invention.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A protective garment for preventing injury to the coccyx and hip areas of a wearer without substantially affecting the maneuverability of said wearer; said garment comprising a generally triangular padded body, a first apex of said triangular body being proportioned to fit into the crotch area of a wearer, second and third apexes of said triangular body falling over the left and right hips of said wearer respectively at the waistline of said wearer, padded material held between front and rear surfaces of said triangular body, a center of said triangular area, sides and base of said triangular area, said padded material being thickest in said center and thinner toward said sides and base of said triangular body garment; fastening straps extending laterally from each side of said base apex, cooperating fastening straps having ends, said straps extending from each side of said first base apex of said crotch intermediate said first base apex and said waistline, means for adjustably fastening said ends of said straps together around upper thighs of the wearer, said upper right and left apexes extending outwardly from said padded body and forming waist straps which adjustably encircle the waist of said wearer to thereby provide padded protection for the hip(s) and coccyx areas of said wearer without interfering significantly with said wearer's movement.

* * * * *